United States Patent [19]

Kando

[11] Patent Number: 4,783,948

[45] Date of Patent: Nov. 15, 1988

[54] METHOD AND APPARATUS FOR BUNDLING AND ELONGATED ARTICLE

[75] Inventor: Akiyoshi Kando, Uozu, Japan

[73] Assignee: Yoshida Kogyo K. K., Tokyo, Japan

[21] Appl. No.: 41,446

[22] Filed: Apr. 23, 1987

[30] Foreign Application Priority Data

Apr. 24, 1986 [JP] Japan ..... 61-95623

[51] Int. Cl.[4] ..... B65B 63/04

[52] U.S. Cl. ..... 53/119; 53/528; 53/586

[58] Field of Search ..... 53/118, 119, 528, 586; 242/67.1 R, 74.1

[56] References Cited

U.S. PATENT DOCUMENTS

| | | | |
|---|---|---|---|
| 3,416,287 | 12/1968 | Hawkins | 53/119 X |
| 3,783,750 | 1/1974 | Heimeiter | 242/67.1 R |
| 3,906,701 | 9/1975 | McIntyre | 53/118 X |
| 4,570,422 | 2/1986 | Watanabe et al. | 53/557 |
| 4,610,124 | 9/1986 | Watanabe et al. | 53/399 |

*Primary Examiner*—John Sipos

*Attorney, Agent, or Firm*—Hill, Van Santen, Steadman & Simpson

[57] ABSTRACT

In a bundling method and apparatus, a relatively long article is wound on a take-up reel and is then released onto a tray in a bundling unit located immediately below the take-up reel. On the tray, the wound article is compressed into a folded and flat posture by a preser, and is then bundled with a bundling band.

8 Claims, 8 Drawing Sheets

METHOD AND APPARATUS FOR BUNDLING AND ELONGATED ARTICLE

BACKGROUND OF THE INVENTION

1. Field of the Invention

The present invention relates to a method of and apparatus for bundling a relatively long article, such as a slide fastener, a touch-and-close surface fastener or a tape, with a bundling band.

2. Description of the Prior Art

U.S. Pat. No. 4,610,124, issued Sept. 9, 1986 to Watanabe, and U.S. Pat. No. 4,570,422, issued Feb. 18, 1986 to Watanabe, exemplify apparatus for automatically bundling relatively short slide fasteners as received in stack on a tray, to which the slide fasteners are discharged successively and directly from a finishing apparatus. As the prior apparatus could not be used for relatively long slide fasteners such as for tents and bed covers, it has hitherto been a common practice to make each finished long slide fastener compact by manually folding, before discharging onto the tray for bundling. This manual folding is laborious and time-consuming, and often causes the bundled slide fastener to easily get out of shape.

SUMMARY OF THE INVENTION

It is thereto an object of the present invention to provide a method of and apparatus for bundling a relatively long article, such as a slide fastener for tent, bed cover and the like, with a bundling band highly efficiently and neatly.

Another object of the invention is to provide a bundling apparatus for relatively long articles, which is simple in construction and hence can be automated with ease, thus causing an improved rate of production.

In the method and apparatus according to the present invention, a relatively long article is wound on a take-up reel and is then released onto a tray located immediately below the take-up reel. On the tray, the wound article is compressed in a folded and flat posture by a presser, and is then bundled with a bundling band.

Many other objects, features and additional advantages of the present invention will become manifest to those versed in the art upon making reference to the detailed description and the accompanying sheets of drawings in which preferred embodiments incorporating the principles of the present invention are shown by way of illustrative example.

DETAILED DESCRIPTION

Figure 1:
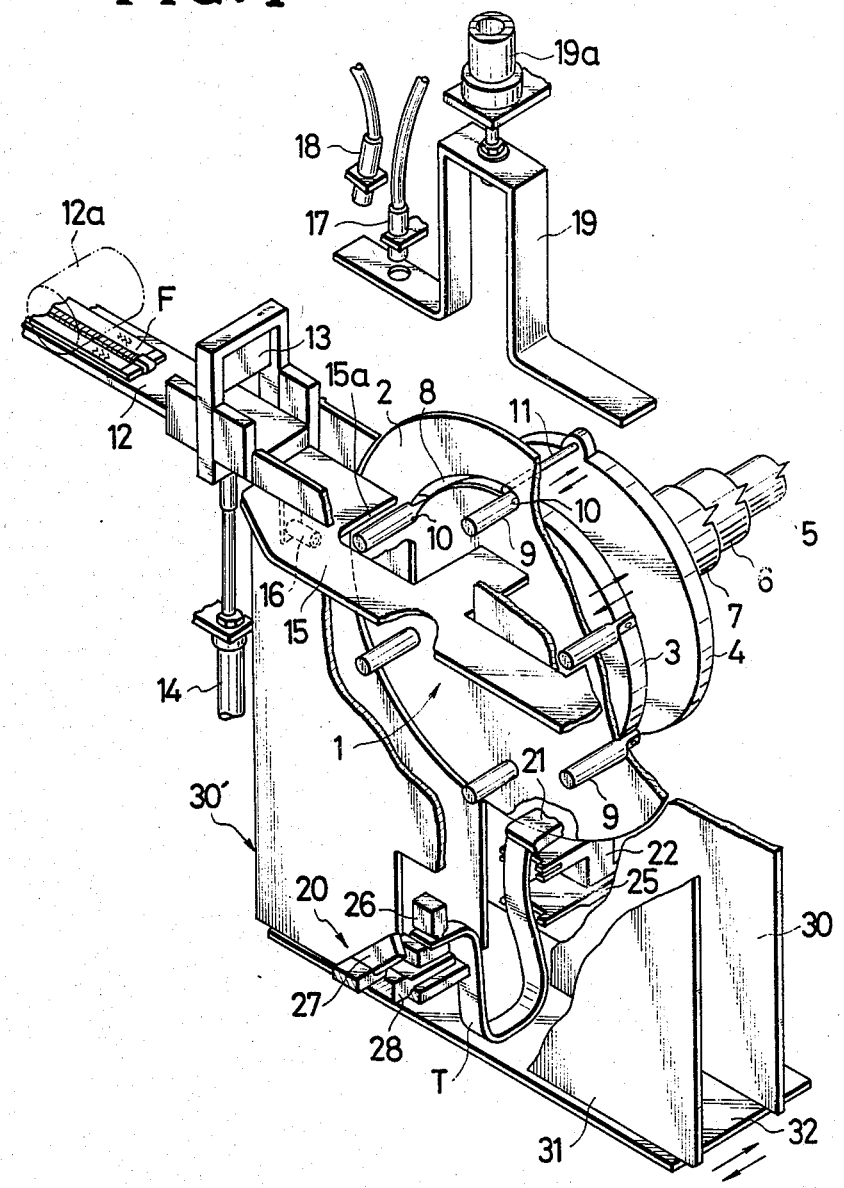
FIG. 1 is a perspective view, partly broken away, of an apparatus for bundling an elongated article according to the present invention.
Figure 2:
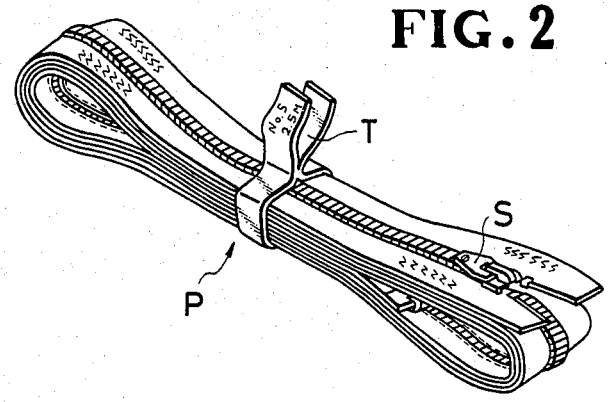
FIG. 2 is a perspective view of the elongated article bundled according to the present invention.

FIG. 1 shows an apparatus for bundling a relatively long or elongated flexible article (hereinafter referred to as "elongated article") F such as a slide fastener with a bundling band T (FIG. 2 and FIGS. 8A–8D) of synthetic resin such as polyethylene or polyvinyl chloride, or laminated plastic or paper and synthetic resin. The elongated article F may be a touch-and-close surface fastener and other tape-like article.

The apparatus generally comprises a take-up reel 1 for winding the elongated article F, a tray 30' disposed below the take-up reel 1 for receiving the wound article F in a flat and folded posture, and a bundling unit 20 disposed below the take-up reel 1 for bundling the folded article F with the bundling band T.

The take-up reel 1 includes first, second and third rotary disks 2, 3, 4 disposed in this order and mounted on first, second and third horizontal concentric shafts 5, 6, 7, respectively. The second and third shafts 6, 7 are in the form of tubes axially movable with respect to the first shaft 5 so as to move the second and third disks 3, 4 toward and away from the first disk 2, for purposes described below. The first disk 2 is operatively connected with a drive through the first shaft 5, which drive is drivable selectively at high and low speeds. The first shaft 5 is frictionally connected with the drive so that the latter can run idly when any undue resistance to rotation is exerted on the first disk 2 and hence the first shaft 5. The first and second disks 2, 3 are corotatable with each other.

The first disk 2 has a plurality of holes 10 (six holes are illustrated here) arranged at equal distance along an imaginary circle that is concentric with the first shaft 5. The first disk 2 has also an arcuate aperture 8 extending along the imaginary circle between an adjacent pair of the holes 10, 10 and communicating therewith.

A plurality of support rods 9 (six rods are illustrated here) are mounted on the second disk 3 at equal distance along its peripheral edge. The support rods 9 are projectable from and retractable into the respective holes 10 as the second disk 3 is moved toward and away from the first disk 2 in response to the axial movement of the second shaft 6. The elongated article F being supplied from the take-up reel 1 via a guide 12 is progressively wound around the support rods 9 while the latter project through the holes 10 in the first disk 2. The extent to which the support rods 9 project from the first disk 2 may be adjusted commensurate with the width of the elongated article F to be wound around the support rods 9. Further, the number of the support rods 9 may be varied as desired.

The third disk 4 has on its periphery a clamp rod 11 that is projectable through and retractable from the arcuate aperture 8. The clamp rod 11 serves, in cooperation with one of the support rods 9, to clamp the leading end Fo of the elongated article F at the beginning of the winding of the elongated article F.

Figure 3A:
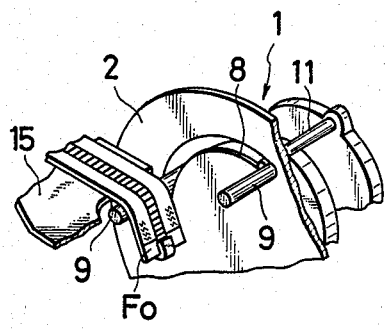
FIGS. 3A,, 3B and 3C are fragmentary perspective views of a take-up reel for winding the elongated article, showing the manner in which a leading end of the elongated article is clamped.
Figure 3B:
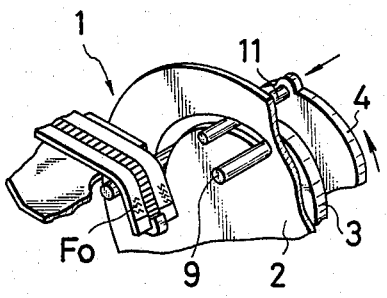
Figure 3C:
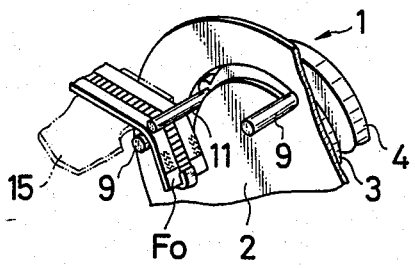
Figure 4:
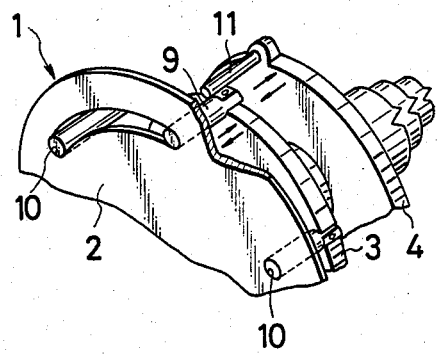
FIG. 4 is a fragmentary perspective view of the take-up reel, showing the positions of support rods and a clamp rod relative to a first disk of the take-up reel.
Figure 6A:
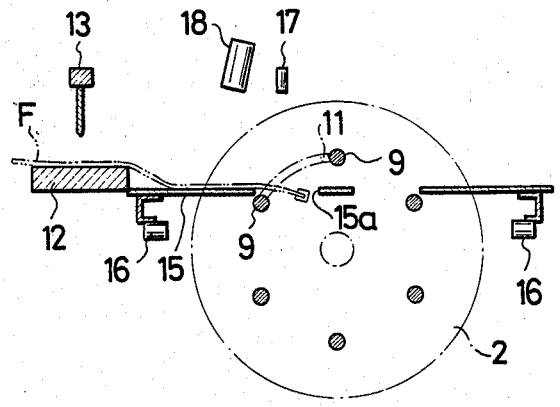
FIGS. 6A through 6D are schematic side elevational views, partly in cross section, of the apparatus, showing the manner in which the elongated article is wound on the reel.
Figure 6B:
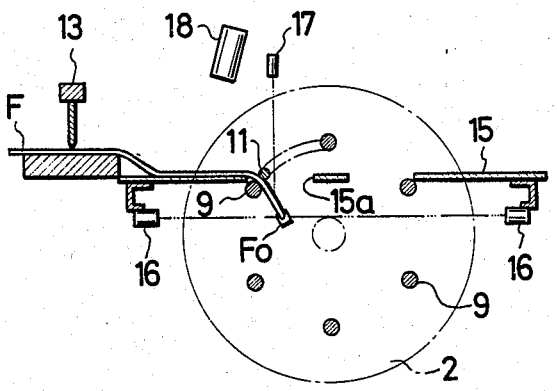
Figure 6C:
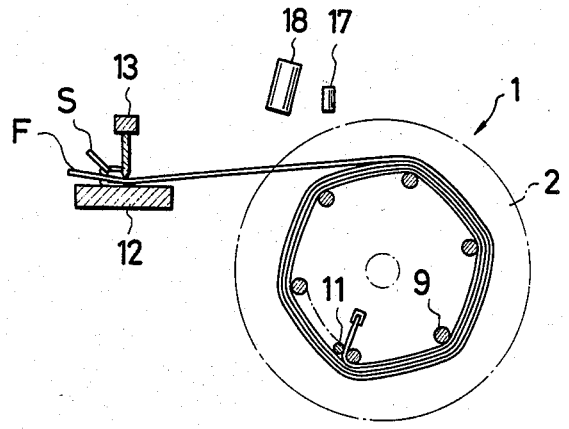
Figure 7A:
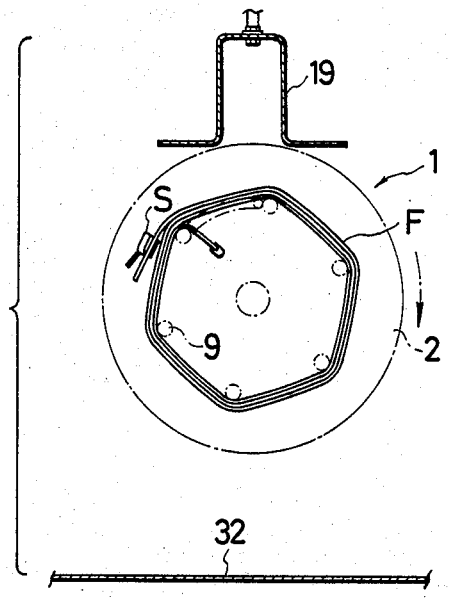
FIGS. 7A and 7B are schematic side elevational view, with parts omitted, of the apparatus, showing the manner in which the wound article is compressed into a flat and folded posture.

Specifically, when the elongated article F is supplied to the reel 1 to such an extent that its leading end Fo extends over the nearest one of the support rods 9, the second disk 4 is axially moved toward the first disk 2 so as to insert the clamp rod 11 through the arcuate aperture 8, as shown in FIG. 3A. With the leading end Fo of the elongated article F extending over the nearest support rod 9, the clamp rod 11 is then moved along the arcuate aperture 8 to clamp the leading end Fo of the elongated article F with the cooperating support rod 9 as the third disk 4 is rotated counterclockwise with respect to the first and second disks 2, 3, as shown in FIGS. 3B, 3C and 6B. During this winding of the elongated article F, the third disk 4 is corotatable with the first and second disks 2, 3, as shown in FIG. 6C. At the end of the winding, the clamp 11 is moved away from the cooperating support rod 9 along the arcuate aperture 8 to release the leading end Fo of the elongated article F, as shown in FIG. 7, as the third disk 4 is rotated clockwise with respect to the first and second disks 2, 3. Upon release of the leading end Fo of the elongated article F, the second and third disks 3, 4 are axially moved away from the first disk 2 until the support rods 9 and the clamp rod 11 are retracted into the holes 10 and the arcuate aperture 8, respectively, as shown in FIG. 4. As a result, the wound article F falls on the tray 30', where the wound article F is bundled in a manner described below.

Figure 9:
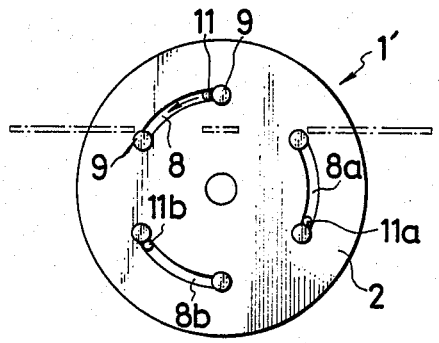
FIGS. 9 and 10 are side elevational views of modified take-up reels.
Figure 10:
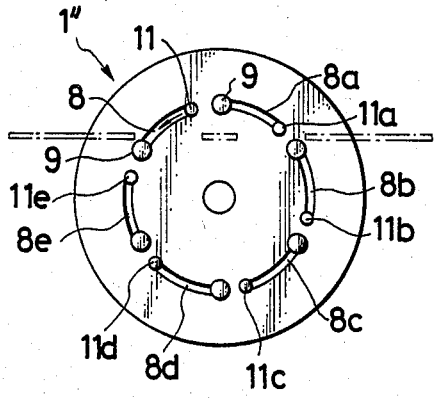

FIGS. 9 and 10 show modified take-up reels 1', 1''. In the take-up reel 1' of FIG. 9, the third disk 3 has two additional clamp rods 11*a*, 11*b* which are projectable from and retractable into two additional arcuate apertures 8*a*, 8*b*, respectively, of the first disk 2, each of the additional arcuate apertures 8*a*, 8*b*, like the arcuate aperture 8, extending between an adjacent pair of the holes 10, 10. In the take-up reel 1'' of FIG. 10, the third disk 4 has six clamp rods 11, 11*a*, 11*b*, 11*c*, 11*d*, 11*e* which are projectable from and retractable into six arcuate apertures 8, 8*a*, 8*b*, 8*c*, 8*d*, 8*e*, respectively, of the first disk 2, each of the arcuate apertures extending from one support rod 10 toward the preceding support rod 10 and terminating short thereof. With the modified take-up reel 1', 1'', it is possible to reduce the time in which the angular position of the first disk 2 is to be adjusted for clamping the leading end Fo of the elongated article F.

Figure 5A:
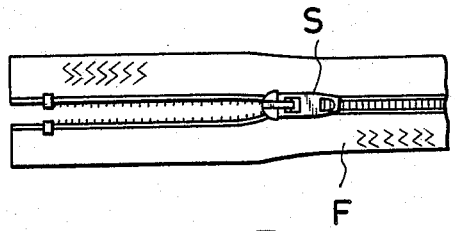
FIGS. 5A and 5B are fragmentary plan views of an elongated slide fastener to be bundled according to the present invention.

As shown in FIG. 1, a guide 12 is disposed upstream of the take-up reel 1 on and along which guide the elongated article F is fed out by means of a feed roller 12*a*. A stop 13 is disposed near the downstream end of the guide 12 and is vertically movable toward and away from the guide 12 by means of an air cylinder 14. The stop 13 serves to stop a slider S while the slide fastener F is progressively wound onto the take-up reel 1, as shown in FIG. 6C. During that time, the slider S is moved from the position of FIG. 5A all the way up to the top end stops, i.e. the position of FIG. 5B.

A guide plate 15 is disposed immediately downstream of the guide 12 as an extension thereof and extends horizontally across the imaginary circle along which the support rods 9 are moved as the take-up reel 1 is in winding operation. The elongated article F is introduced along the guide plate 15 via a cutout 15*a* thereof into the take-up reel 1 so that the leading end Fo of the elongated article F extends over one support rod 9 for being clamped between the latter and the clamp rod 11. After completion of the clamping operation of the reel 1 and before start of the winding operation of the reel 1, the guide plate 15 is retractable sideways from the first disk 2.

A pair of photoelectric tubes 16, 16 (FIGS. 6A and 6B) are mounted under the guide plate 15 for detecting the arrival of the leading end Fo of the elongated article F at the position in which the leading end Fo is to be clamped. An air blow nozzle 17 is disposed above that position for forcing air against the leading end Fo of the elongated article F until the leading end Fo is bent down to the right path between the photoelectric tubes 16, 16, as shown in FIG. 6B. With the air blow nozzle 17, the arrival of the leading end Fo of the elongated article F can be reliably detected by the photoelectric tubes 16. If the elongated article F is enough flexible to be bent freely, the air blow nozzle 17 may be omitted.

Figure 6D:
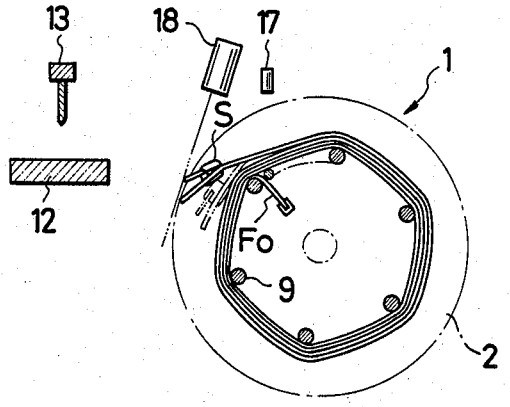

A photoelectric tube 18 of reflection type is disposed near the air blow nozzle 17 for detecting the arrival of the trailing end of the elongated article F at the take-up reel 1, as shown in FIG. 6D. Upon this detection, the rotation of the first disk 2 and hence the winding of the elongated article F is terminated so that its trailing end will be disposed at a predetermined position on the upper side of the article F as the latter is flattened and folded (FIG. 7B).

Figure 7B:
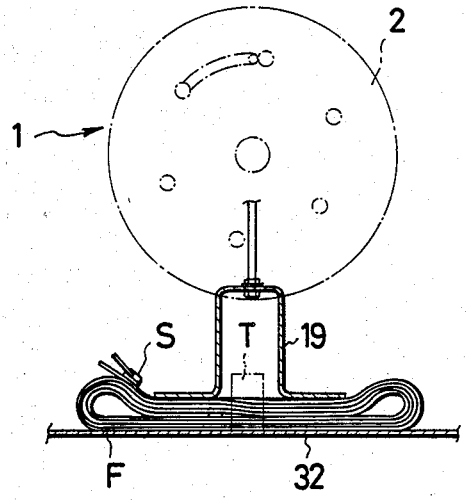
Figure 8A:
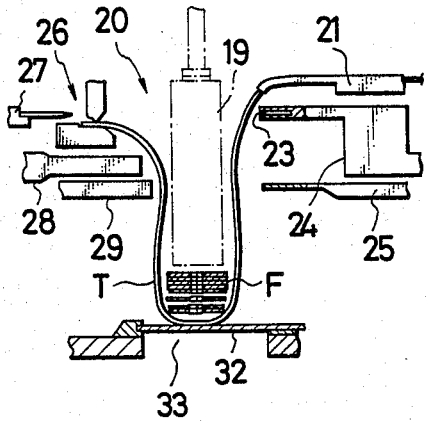
FIGS. 8A through 8D are schematic side elevational views of a bundling unit, showing the manner in which the folded article is bundled.
Figure 8B:
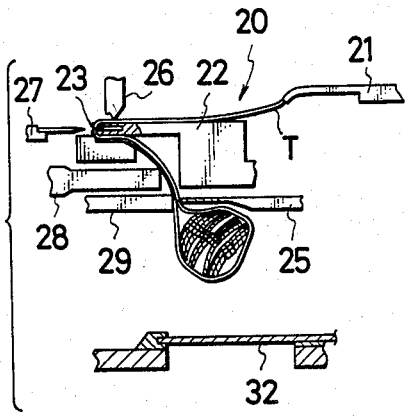

The bundling unit 20 includes a presser 19 (FIGS. 1, 7A, 7B and 8A) which is normally disposed above the take-up reel 1 and is retractably downwardly movable, in response to the release of the wound article F from the take-up reel 1, toward the bottom plate 32 of the tray 30' for compressing the wound article F into a flat and folded posture, as shown in FIGS. 7B and 8A.

As shown in FIGS. 8A–8D, the bundling unit 20 also includes a reel (not shown) supporting a roll of continuous band web T, a band web guide 21 through which the band web T is to be fed out across the tray 30' from one side thereof, a clamp 26 disposed at the other side of the tray 30' for clamping a leading end of the band web T, an upper pusher 22 disposed below the band web guide 21 and retractably movable toward the clamp 26 for pushing a first portion (remote from the leading end) of the band web T into the clamp 26, and a cutter 47 disposed behind the clamp 26 and retractably movable toward the clamp 26 into a slit 23 of the upper pusher 22 for cutting the band web T at the first portion to thereby provide an individual bundling band T.

The bundling unit 20 further includes a lower pusher 25 disposed below the upper pusher 22 and retractably movable toward a lower anvil 29 below the clamp 26 for pushing a pair of spaced second portions (between the leading end and the first portion) of the band web T against the lower anvil 29 to thereby surround the folded article F, and an ultrasonic horn 28 disposed between the clamp 26 and the lower anvil 29 for fusing or welding the band web T as the latter is clamped between the ultrasonic horn 28 and an upper anvil 22, which is integral with the upper pusher 22 and hence retractably movable toward the ultrasonic horn 28. As shown in FIG. 8D, the bottom plate 32 of the tray 30' is movable sideways (rightwardly) to provide a discharge opening 33 through which the bundled article P is to be discharged.

The mode of operation of the apparatus described above will now be explained as the slide fastener is used as the elongated article F.

At the start of operation of the apparatus, as shown in FIGS. 1 and 6A, the first disk 2 is positioned in such an angular position that the arcuate aperture 8 is disposed near the guide 12. The second disk 3 is disposed close to the first disk 2, with the support rods 9 projecting from the front surface of the first disk 2. The third disk 4 is disposed remotely from the first disk 2 so that the clamp rod 11 is retracted in the arcuate aperture 8 remotely from the guide 12, as shown in FIG. 3A. The guide plate 15 also is disposed close to the front surface of the first disk 2. The stop 13 is in its raised position. Meanwhile, in the bundling unit 20, a predetermined length of the band web T is unreeled into the tray 30' in a substantially U shape with its free end clamped by the clamp 26, as shown in FIG. 1. The upper and lower pushers 22, 25 the upper and lower anvils 24, 29 and the ultrasonic horn 28 are in their retracted positions, as shown in FIG. 8A. Further, the bottom plate 32 of the tray 30' is in closed position.

When the elongated slide fastener F is supplied via the guide 12 and the guide plate 15 toward the take-up reel 1 to such an extent that the leading end Fo extends over the nearest support rod 9 (FIG. 6A), a jet air from the air blow nozzle 17 causes the leading end Fo to bend downwardly until it interrupts the light path between the two photoelectric tubes 16, 16, as shown in FIG. 6B. Thus the arrival of the leading end Fo of the slide fastener F has been detected.

Upon this detection, the third disk 4 is moved close to the first disk 2 so as to cause the clamp rod 11 to project from the front surface of the first disk 2, and the third disk 4 is then rotated counterclockwise so as to cause the clamp rod 11 to move toward the nearest support rod 9 until the leading end Fo of the slide fastener F is clamped between the support rod 9 and the clamp rod 11, as shown in FIGS. 3A–3C and 6B.

Figure 5B:
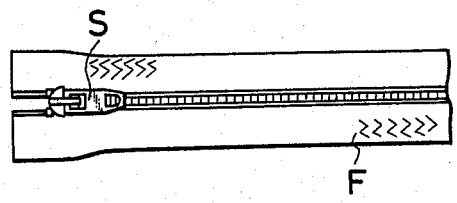

Upon completion of the clamping of the leading end Fo of the slide fastener F, the guide plate 15 is retracted sideways (leftwardly in FIG. 1) so that the take-up reel 1 can be rotated for winding the slide fastener F. At the same time, the stop 13 is lowered toward the upper surface of the slide fastener F on the guide 12, as shown in FIG. 6B. Then the first shaft 5 and hence the first disk 2 is driven clockwise at high rate of rotation to wind the slide fastener F around the support rods 9, during which time the slider S blocked by the stop 13 is moved relative to the slide fastener F all the way up to the top end stops, as shown in FIGS. 5B and 6C. As a result, supply of the slide fastener F is temporarily halted, and slacks in the wound slide fastener F are eliminated as the non-illustrated drive for the first shaft 5 of the first disk 2 runs idly.

Subsequently, the driving of the take-up reel 1 is switched over to a low rate of rotation and, at the same time, the stop 13 is raised to release the slider S, thus allowing the trailing end portion of the slide fastener F to be wound onto the reel 1, as shown in FIG. 6D. When the arrival of the trailing end of the slide fastener F at the take-up reel 1 is detected by the reflection-type photoelectric tube 18 (FIG. 6D), the rotation of the take-up reel 1 is terminated.

Upon termination of rotation of the take-up reel 1, the second and third disks 3, 4 are moved away from the first disk 1 to bring the support rods 9 and the clamp rod 11 to their retracted positions (FIG. 4), thus allowing the wound slide fastener F to fall onto the bottom plate 32 of the tray 30' centrally across the relaxed band web T (FIG. 8A). Then the presser 19 is lowered by an air cylinder **19*a* (FIG. 1) to compress the wound slide fastener F in a flat and folded posture, as shown in FIGS. 7B and 8A. After compression, the presser 19** is returned to its raised position.

Then, the upper pusher 22 is moved forwardly to push the first portion of the band web T forcibly into the clamp 26 (FIG. 8B), bringing the upper anvil 24 toward the ultrasonic horn 28. At the same time, the lower pusher 25 also is moved forwardly to push the second portions of the band web T against the lower anvil 29, thus surrounding the folded slide fastener F by the band web T.

Figure 8C:
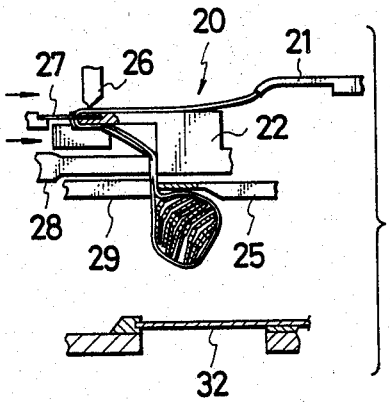
Figure 8D:
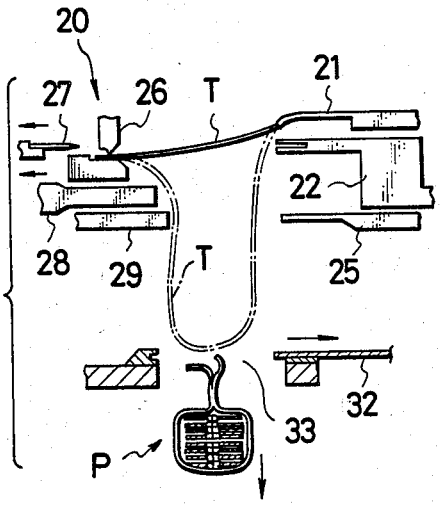

Finally, as shown in FIG. 8C, the cutter 27 is moved forwardly into the slot 23 of the upper pusher 22 to cut the band web T, and at the same time, the ultrasonic horn 28 is moved forwardly to press the band web T against the upper anvil 24, thereby fusing or welding the band web T at portions immediately above the second portions. Upon completion of the cutting and the welding, the upper and lower pushers 22, 25, the cutter 27 and the ultrasonic horn 28 are returned to their original or retracted positions (FIG. 8D), releasing the folded slide fastener T bundled by the bundling band T. As a result a bundled article P has been obtained. As the bottom plate 32 of the tray 30' is moved sideways to provide a discharge opening 33, the bundled article P is discharged through the opening 33. Thus a single cycle of the operation of the bundling apparatus has been completed.

Illustrated by dash-and-dot lines in FIG. 8D is a fresh length of the band web T having been unreeled for use in bundling a succeeding slide fastener F.

Although, in the illustrated embodiment, the elongated article F is a slide fastener having a slider S to be blocked by the stop 13 during the winding, it may be a touch-and-close surface fastener or other tape-like garment article, which do not have a slider or similar part. In such alternative case, a trailing end of the article may be detected at the guide 12 by a suitable means such as a photoelectric tube, and the stop 13 may be lowered, in response to such detection, to temporarily halt the movement of the article. Otherwise, in response to such detection, the drive for the first shaft 5 and hence the first disk 2 may be switched over from high-speed driving to low-speed driving.

For bundling a single elongated article at spaced portions with two separate bands T, T, two identical bundling units 20, 20 may be set below the take-up reel 1.

According to the present invention, since the article is wound and then folded flat prior to the bundling, it is possible to bundle even the relatively long article with maximum ease. Further, because the winding of the article is switched over from high speed to low speed immediately before the trailing end of the article leaves the guide, and because the winding of the article is terminated so that the trailing end of the article will be disposed at the upper side of the article when the latter is folded flat, the article can be bundled efficiently and neatly without getting out of shape. Moreover, the bundling apparatus is simple in construction and hence can be automated with ease, causing an improved rate of production.

Although various minor modifications may be suggested by those versed in the art, it should be understood that I wish to embody within the scope of the patent granted hereon, all such embodiments as reasonably and properly come within the scope of my contribution to the art.

What is claimed is:

1. An appratus for bundling a relatively long article with a bundling band, said apparatus comprising:

(a) a guide on and along which the article is to be supplied;

(b) a take-up reel disposed dowstream of a downstream end of said guide for winding the article therefrom;

(c) a tray disposed below said take-up reel for receiving the wound article;

(d) a presser disposed above said tray and vertically movable toward said tray for compressing the wound article in a folded and flat posture; and (e) a bundling unit disposed near said tray for bundling the folded article with the bundling band; wherein said take-up reel is adapted to be driven selectively at high and low rates of rotation, and said tape-up reel includes:

(1) a first disk mounted on a first horizontal shaft adapted to be connected to a drive which is switchable between high and low speed drivings, said first disk having a plurality of holes arranged at equal distance along an imaginary circle that is concentric with said first shaft and having at least one arcuate aperture extending along the imaginary circle between an adjacent pair of holes;

(2) a second disk disposed behind said first disk and mounted on a second shaft in the form of a tube disposed concentrically around said first shaft, said second disk being thereby movale toward and away from said first disk, said second disk having a plurality of support rods on and along its peripheral edge at equal distance which are projectable from and retractable into the respective holes in response to the movement of said second disk, said support rods as projected being supportable therearound the article, said support rods as retracted being releasable therefrom the article; and (3) a third disk disposed being said second disk and mounted on a third shaft in the form of a tube disposed concentrically around said second shaft, said third disk being movable toward and away from said first disk and also rotatable around said first and second shafts, said third disk having on its priphery at least one clamp rod which is projectable from and retractable into said arcuate aperture and which is movable along said arcuate aperture toward and away from one of said support rods from clamping a leading end of the article at the beginning of the winding.

2. An apparatus according to claim 1, further including a guide plate disposed immediately downstream of said guide as an extension thereof and extending horizontally across said imaginary circle and close to said first disk, said guide plate having a cutout through which the leading end portion of the article is to be introduced over one of said support rods, said guide plate being retractable sideways from said first disk after completion of the clamping operation of said take-up reel and before start of the winding operation of said take-up reel.

3. An apparatus according to claim 2, further including first detecting means for detecting the arrival of the leading end of the article at said take-up reel, and second detecting means for detecting the arrival of a trailing end of the article at said take-up reel.

4. An apparatus according to claim 3, said first detecting means including a pair of photoelectric tubes mounted under said guide plate for sensing the leading end of the article when it passes across a light path between said photoelectric tubes.

5. An apparatus according to claim 4, said first detecting means further including an air blow nozzle disposed above said take-up reel for forcing air against the leading end of the article extending over said one support rod, until the leading end is bent down to the light path between said photoelectric tubes.

6. An apparatus according to claim 3, said second detecting means including a photoelectric tube of refrection type disposed above said take-up reel.

7. An apparatus according to claim 3, further including a stop disposed near said downstream end of said guide and vertically movable toward and away from said guide for temporarily holding the trailing end of the article until slacks in the article wound on said support rods are eliminated, said stop being retractable from said guide for releasing the trailing end of the article when said drive is switched over from the high-speed driving to the low-speed driving.

8. An apparatus according to claim 6, further including third detecting means for detecting the approach of the trailing end of the article to said downstream end of said guide.

* * * * *